US007296788B2

(12) United States Patent
Terao et al.

(10) Patent No.: US 7,296,788 B2
(45) Date of Patent: Nov. 20, 2007

(54) WAITING TRAY FOR SHEET PROCESSING TRAY

(75) Inventors: Yasunobu Terao, Tagata-gun (JP); Mikio Yamamoto, Tagata-gun (JP); Tomomi Iijima, Mishima (JP); Reiji Murakami, Yokohama (JP); Hiroyuki Taki, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/008,290

(22) Filed: Dec. 10, 2004

(65) Prior Publication Data

US 2006/0066027 A1 Mar. 30, 2006

(30) Foreign Application Priority Data

Sep. 28, 2004 (JP) ..... 2004-281770

(51) Int. Cl.
*B65H 37/04* (2006.01)

(52) U.S. Cl. ..... 270/58.08; 270/58.11; 270/58.12; 270/58.14; 270/58.18; 399/410; 271/189; 271/190; 271/191; 271/192

(58) Field of Classification Search ..... 270/58.08, 270/58.11, 58.12, 58.14, 58.18; 399/410; 271/189, 190, 191, 192
See application file for complete search history.

(56) References Cited

U.S. PATENT DOCUMENTS

| | | | |
|---|---|---|---|
| 4,473,425 | A | 9/1984 | Baughman et al. |
| 4,611,741 | A | 9/1986 | Wilson |
| 4,794,859 | A | 1/1989 | Huseby et al. |
| 4,898,374 | A | 2/1990 | Vermaat |
| 4,917,366 | A | 4/1990 | Murakami et al. |
| 5,020,784 | A | 6/1991 | Asami et al. |
| 5,021,837 | A | 6/1991 | Uto et al. |

(Continued)

FOREIGN PATENT DOCUMENTS

| | | | |
|---|---|---|---|
| JP | 61-078162 | U | 5/1986 |

(Continued)

OTHER PUBLICATIONS

U.S. Appl. No. 11/008,122, filed Dec. 10, 2004, Sasahara.

(Continued)

*Primary Examiner*—Gene O. Crawford
*Assistant Examiner*—Leslie A Nicholson, III
(74) *Attorney, Agent, or Firm*—Foley & Lardner LLP

(57) ABSTRACT

A sheet post-process apparatus includes a waiting tray and a processing tray. The waiting tray is provided in the middle of a conveying path so that a downward side end in a conveying direction of sheets is oriented upwardly. In the case where a postprocess is required, sheets are made standby. The processing tray has a function which causes the sheets made standby on the waiting sheet to be dropped by self-weight. With this function, the processing tray receives the sheets moved to be dropped and the sheets conveyed from the conveying path without intervening the waiting tray, before carrying out the post-process. In addition, an upstream side end in a conveying direction of the sheets on the waiting tray and a downstream side end in a conveying direction of the sheets on the processing tray are allocated to overlap on each other in the conveying direction of the sheets.

12 Claims, 11 Drawing Sheets

U.S. PATENT DOCUMENTS 5,098,074 A 3/1992 Mandel et al.
5,282,611 A 2/1994 Ueda et al.
5,285,249 A 2/1994 Mahoney
5,289,251 A 2/1994 Mandel et al.
5,337,134 A 8/1994 Sato et al.
5,370,384 A 12/1994 Romanowski
5,418,606 A 5/1995 Kikuchi et al.
5,435,544 A 7/1995 Mandel
5,449,157 A 9/1995 Kawano et al.
5,451,037 A 9/1995 Lundstrom
5,590,871 A 1/1997 Okabe et al.
5,622,359 A 4/1997 Kawano et al.
5,628,502 A 5/1997 Amarakoon
5,640,232 A 6/1997 Miyake et al.
5,676,517 A 10/1997 Lotz
5,709,376 A 1/1998 Ushirogata
5,934,140 A 8/1999 Jackson et al.
5,961,274 A 10/1999 Bors
5,971,384 A 10/1999 Asao
6,022,011 A 2/2000 Hirose
6,065,747 A 5/2000 Khovaylo et al.
6,092,948 A 7/2000 Altfather
6,102,385 A 8/2000 Wakamatsu et al.
6,120,020 A 9/2000 Asao
6,142,461 A 11/2000 Asao et al.
6,145,828 A 11/2000 Arai
6,146,085 A 11/2000 Namba et al.
6,231,039 B1 5/2001 Chung
6,330,999 B2 * 12/2001 Coombs et al. ..... 270/58.18
6,336,630 B1 1/2002 Holtman et al.
6,354,059 B1 3/2002 Yoshie et al.
6,357,753 B1 3/2002 Yamasaki et al.
6,371,472 B1 4/2002 Miyake et al.
6,450,934 B1 * 9/2002 Coombs ..... 493/383
6,505,829 B2 1/2003 Kawata
6,581,922 B2 6/2003 Kuwata et al.
6,600,885 B2 7/2003 Kida
6,641,129 B2 11/2003 Ogita et al.
6,659,455 B2 12/2003 Endo et al.
6,671,492 B2 12/2003 Mimura et al.
6,674,983 B2 1/2004 Enomoto et al.
6,698,744 B2 3/2004 Yamada et al.
6,712,349 B2 3/2004 Watanabe
6,722,646 B2 4/2004 Sekiyama et al.
6,722,650 B1 4/2004 Abbata et al.
6,733,006 B2 5/2004 Kobayashi et al.
6,733,007 B2 5/2004 Sekiyama et al.
6,767,012 B2 7/2004 Sasamoto
6,819,906 B1 11/2004 Herrmann et al.
6,824,128 B2 11/2004 Nagata et al.
6,848,685 B2 2/2005 Katsuyama
6,871,042 B2 3/2005 Nemura et al.
6,910,686 B2 6/2005 Awano
6,928,259 B2 8/2005 Sakuma
6,988,728 B2 1/2006 Kida
7,104,538 B1 9/2006 Kimura et al.
2002/0047233 A1 4/2002 Coombs et al.
2002/0053766 A1 5/2002 Kubota
2002/0074708 A1 6/2002 Nagata et al.
2002/0163119 A1 11/2002 Kawata
2003/0057625 A1 3/2003 Kuwata et al.
2003/0155705 A1 8/2003 Sekiyama et al.
2003/0214090 A1 11/2003 Kato et al.
2004/0032073 A1 2/2004 Sasamoto
2004/0113348 A1 6/2004 Awano
2004/0126163 A1 7/2004 Asami et al.
2004/0181308 A1 9/2004 Hayashi et al.
2005/0000336 A1 1/2005 Hattori et al.

FOREIGN PATENT DOCUMENTS

JP 62-008965 A 1/1987
JP 63-035756 U 3/1988
JP 63-180673 A 7/1988
JP 02-055369 A 2/1990
JP 03-088667 A 4/1991
JP 04-079857 U 7/1992
JP 04-312894 A 11/1992
JP 04-354756 A 12/1992
JP 05-238103 A 9/1993
JP 08-259073 A 10/1996
JP 10-095563 A 4/1998
JP 10-279169 A 10/1998
JP 10-324449 A 12/1998
JP 11-011786 A 1/1999
JP 11-043257 A 2/1999
JP 11-147641 A 6/1999
JP 11-208967 A 8/1999
JP 11-231753 A 8/1999
JP 11-301912 A 11/1999
JP 2000-095420 A 4/2000
JP 2000-159414 A 6/2000
JP 2001-048411 A 2/2001
JP 2001-89009 A 4/2001
JP 2001-316029 A 11/2001
JP 2002-060118 A 2/2002
JP 2002-308509 A 10/2002
JP 2003-081517 A 3/2003
JP 2003081517 A * 3/2003
JP 2003-171057 A 6/2003
JP 2003-246536 A 9/2003
JP 2003-335450 A 11/2003
JP 2004-142868 A 5/2004

OTHER PUBLICATIONS

U.S. Appl. No. 11/008,124, filed Dec. 10, 2004, Terao et al.
U.S. Appl. No. 11/008,131, filed Dec. 10, 2004, Terao et al.
U.S. Appl. No. 11/008,132, filed Dec. 10, 2004, Terao et al.
U.S. Appl. No. 11/008,142, filed Dec. 10, 2004, Terao et al.
U.S. Appl. No. 11/008,145, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,199, filed Dec. 10, 2004, Terao et al.
U.S. Appl. No. 11/008,222, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,251, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,294, filed Dec. 10, 2004, Terao et al.
U.S. Appl. No. 11/008,295, filed Dec. 10, 2004, Terao et al.
U.S. Appl. No. 11/008,299, filed Dec. 10, 2004, Terao et al.
U.S. Appl. No. 11/008,349, filed Dec. 10, 2004, Terao et al.
U.S. Appl. No. 11/008,350, filed Dec. 10, 2004, Terao et al.
U.S. Appl. No. 11/008,381, filed Dec. 10, 2004, Terao et al.
U.S. Appl. No. 11/008,392, filed Dec. 10, 2004, Terao et al.
U.S. Appl. No. 11/008,567, filed Dec. 10, 2004, Terao et al.
Y. Terao, et al., Notice of Allowance and Fee(s) Due, U.S. App. No. 11/008,124, Sep. 30, 2005, 9 pages.
Y. Terao, et al., Notice of Allowance and Fee(s) Due, U.S. App. No. 11/008,132, Oct. 6, 2005, 9 pages.
Y. Terao et al., U.S. PTO Office Action, U.S. Appl. No. 11/008,122, filed Nov. 21, 2005, 9 pages.
Y. Terao et al., U.S. PTO Office Action, U.S. Appl. No. 11/008,244, filed Nov. 21, 2005, 10 pages.
Y. Terao et al., U.S. PTO Office Action, U.S. Appl. No. 11/008,257, filed Nov. 30, 2005, 9 pages.

Y. Terao et al., U.S. PTO Office Action, U.S. Appl. No. 11/008,271, filed Nov. 30, 2005, 9 pages.
Y. Terao et al., U.S. PTO Office Action, U.S. Appl. No. 11/008,392, filed Dec. 14, 2005, 9 pages.
Y. Terao et al., U.S. PTO Office Action, U.S. Appl. No. 11/008,294, filed Dec. 13, 2005, 9 pages.
Y. Terao et al., U.S. PTO Office Action, U.S. Appl. No. 11/008,299, filed Dec. 13, 2005, 9 pages.
Y. Terao et al., U.S. PTO Office Action, U.S. Appl. No. 11/008,349, filed Dec. 13, 2005, 9 pages.
Y. Terao et al., U.S. PTO Office Action, U.S. Appl. No. 11/008,567, filed Dec. 13, 2005, 9 pages.
Y. Terao et al., U.S. PTO Office Action, U.S. Appl. No. 11/008,148, filed Jan 11, 2006, 12 pages.
Y. Terao et al., U.S. PTO Office Action, U.S. Appl. No. 11/008,251, filed Jan 13, 2006, 11 pages.
Y. Terao et al., U.S. PTO Office Action, U.S. Appl. No. 11/008,295, filed Jan 5, 2006, 11 pages.
Y. Terao et al., U.S. PTO Office Action, U.S. Appl. No. 11/008,350, filed Jan 26, 2006, 12 pages.
U.S. Appl. No. 11/085,226, filed Mar. 22, 2005, Terao et al.
U.S. Appl. No. 11/085,227, filed Mar. 22, 2005, Terao et al.
U.S. Appl. No. 11/085,240, filed Mar. 22, 2005, Terao et al.
U.S. Appl. No. 11/085,241, filed Mar. 22, 2005, Terao et al.
U.S. Appl. No. 11/085,242, filed Mar. 22, 2005, Terao et al.
U.S. Appl. No. 11/085,243, filed Mar. 22, 2005, Terao et al.
U.S. Appl. No. 11/085,244, filed Mar. 22, 2005, Terao et al.
U.S. Appl. No. 11/085,247, filed Mar. 22, 2005, Terao et al.
U.S. Appl. No. 11/085,248, filed Mar. 22, 2005, Terao et al.
U.S. Appl. No. 11/085,250, filed Mar. 22, 2005, Terao et al.
U.S. Appl. No. 11/085,251, filed Mar. 22, 2005, Iizuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
Y. Terao et al., U.S. PTO Notice of Allowance, U.S. Appl. No. 11/085243, Jan. 5, 2006, with attached Notice of Withdrawal from Issue dated Jan. 10, 2006, 10 pgs.
Y. Terao et al., U.S. PTO Office Action, U.S. Appl. No. 11/008,131, filed Feb. 23, 2006, 9 pgs.
Y. Terao et al., U.S. PTO Office Action, U.S. Appl. No. 11/008,222, filed Feb. 24, 2006, 12 pgs.
Y. Terao et al., U.S. PTO Office Action, U.S. Appl. No. 11/008,230, filed Feb. 24, 2006, 11 pgs.
Y. Terao et al., U.S. PTO Office Action, U.S. Appl. No. 11/085,226, filed Jan. 13, 2006, 9 pgs.
Y. Terao et al., U.S. PTO Office Action, U.S. Appl. No. 11/085,227, filed Feb. 9, 2006, 9 pgs.
Y. Terao et al., U.S. PTO Office Action, U.S. Appl. No. 11/085,240, filed Jan 26, 2006, 8 pgs.
Y. Terao et al., U.S. PTO Office Action, U.S. Appl. No. 11/085,241, filed Feb. 9, 2006, 9 pgs.
Y. Terao et al., U.S. PTO Office Action, U.S. Appl. No. 11/085,243, filed Jan. 26, 2006, 6 pgs.
Y. Terao et al., U.S. PTO Office Action, U.S. Appl. No. 11/085,244, filed Feb. 9, 2006, 7 pgs.
K. Sasahara et al., U.S. PTO Office Action, U.S. Appl. No. 11/008,122, filed Apr. 19, 2006, 10 pages.
Y. Terao et al., Notice of Allowance and Fee(s) Due, U.S. Appl. No. 11/008,199, filed Apr. 20, 2006, 15 pages.
Y. Terao et al., Notice of Allowance and Fee(s) Due, U.S. Appl. No. 11/008,247, filed May 1, 2006, 16 pages.
Y. Terao et al., Notice of Allowance and Fee(s) Due, U.S. Appl. No. 11/008,349, filed May 2, 2006, 9 pages.
Y. Terao et al., U.S. PTO Office Action, U.S. Appl. No. 11/008,224, filed Apr. 21, 2006, 12 pages.
Y. Terao et al., U.S. PTO Office Action, U.S. Appl. No. 11/008,257, filed Apr. 28, 2006, 13 pages.
Y. Terao et al., U.S. PTO Office Action, U.S. Appl. No. 11/008,271, filed Apr. 25, 2006, 14 pages.
Y. Terao et al., U.S. PTO Office Action, U.S. Appl. No. 11/008,294, filed May 5, 2006, 13 pages.
Y. Terao et al., U.S. PTO Office Action, U.S. Appl. No. 11/008,299, filed May 5, 2006, 12 pages.
Y. Terao et al., U.S. PTO Office Action, U.S. Appl. No. 11/008,392, filed Apr. 26, 2006, 10 pages.
Y. Terao et al., Notice of Allowance and Fee(s) Due, U.S. Appl. No. 11/008,148, filed Jun. 26, 2006, 10 pages.
Y. Terao et al., Notice of Allowance and Fee(s) Due, U.S. Appl. No. 11/008,251, filed Jun. 26, 2006, 10 pages.
Y. Terao et al., Notice of Allowance and Fee(s) Due, U.S. Appl. No. 11/085,241, filed Jun. 26, 2006, 10 pages.
Y. Terao et al., Notice of Allowance and Fee(s) Due, U.S. Appl. No. 11/085,243, filed Jun. 26, 2006, 10 pages.
Y. Terao et al., U.S. PTO Office Action, U.S. Appl. No. 11/008,132, filed Jun. 9, 2006, with attached Notice of Withdrawal from Issue dated May 30, 2006, 11 pgs.
Y. Terao et al., U.S. PTO Office Action, U.S. Appl. No. 11/008,295, filed Jun. 23, 2006, 14 pgs.
Y. Terao et al., Notice of Allowance and Fee(s) Due, U.S. Appl. No. 11/008,295, filed Sep. 21, 2006, 7 pages.
Y. Terao et al., Notice of Allowance and Fee(s) Due, U.S. Appl. No. 11/008,350, filed Sep. 21, 2006, 7 pages.
Y. Terao et al., Notice of Allowance and Fee(s) Due, U.S. Appl. No. 11/008,392, filed Sep. 15, 2006, 10 pages.
Y. Terao et al., U.S. PTO Office Action, U.S. Appl. No. 11/008,381, filed Aug. 23, 2006, 17 pages.
Y. Terao et al., U.S. PTO Office Action, U.S. Appl. No. 11/008,567, filed Aug. 21, 2006, 14 pages.
Y. Terao et al., Notice of Allowance and Fee(s) Due, U.S. Appl. No. 11/008,222, filed Aug. 31, 2006, 12 pages.
Y. Terao et al., Notice of Allowance and Fee(s) Due, U.S. Appl. No. 11/008,299, filed Sep. 6, 2006, 9 pages.
Y. Terao et al., Notice of Allowance and Fee(s) Due, U.S. Appl. No. 11/085,244, filed Jul. 13, 2006, 10 pages.
Y. Terao et al., U.S. PTO Office Action, U.S. Appl. No. 11/008,145, filed Jun. 30, 2006, 6 pgs.
Y. Terao et al., U.S. PTO Office Action, U.S. Appl. No. 11/008,147, filed Jul. 7, 2006, 4 pgs.
Y. Terao et al., U.S. PTO Office Action, U.S. Appl. No. 11/008,350, filed Jul. 6, 2006, 12 pgs.
Y. Terao et al., U.S. PTO Office Action, U.S. Appl. No. 11/085,226, filed Jul. 20, 2006, 12 pages.
Y. Terao et al., U.S. PTO Office Action, U.S. Appl. No. 11/085,227, filed Aug. 11, 2006, 15 pages.
Y. Terao et al., U.S. PTO Office Action, U.S. Appl. No. 11/085,240, filed Aug. 2, 2006, 15 pages.
Y. Terao et al., U.S. PTO Office Action, U.S. Appl. No. 11/085,247, filed Jul. 13, 2006, 14 pgs.
Y. Terao et al., U.S. PTO Office Action, U.S. Appl. No. 11/085,248, filed Jul. 5, 2006, 15 pgs.
Y. Terao et al., U.S. PTO Office Action, U.S. Appl. No. 11/085,256, filed Jul. 13, 2006, 13 pgs.
Y. Terao et al., U.S. PTO Office Action, U.S. Appl. No. 11/085,625, filed Jul. 28, 2006, 13 pgs.
Y. Terao, et al., Notice of Allowance and Fee(s) Due, U.S. Appl. No. 11/008,122, filed Jul. 26, 2006, 8 pgs.
Y. Terao et al., Notice of Allowance and Fee(s) Due, U.S. Appl. No. 11/008,145, filed Dec. 14, 2006, 20 pages.
Y. Terao et al., Notice of Allowance and Fee(s) Due, U.S. Appl. No. 11/008,147, filed Nov. 17, 2006, 7 pages.
Y. Terao et al., U.S. PTO Office Action, U.S. Appl. No. 11/008,131, filed Oct. 17, 2006, 15 pages.
Y. Terao et al., U.S. PTO Office Action, U.S. Appl. No. 11/008,132, filed Nov. 24, 2006, 16 pages.
Y. Terao et al., U.S. PTO Office Action, U.S. Appl. No. 11/008,224, filed Nov. 17, 2006, 13 pages.
Y. Terao et al., U.S. PTO Office Action, U.S. Appl. No. 11/008,230, filed Nov. 13, 2006, 17 pages.
Y. Terao et al., U.S. PTO Office Action, U.S. Appl. No. 11/008,294, filed Oct. 24, 2006, 11 pages.
Y. Terao et al., U.S. PTO Office Action, U.S. Appl. No. 11/085,248, filed Oct. 24, 2006, 12 pages.
Y. Terao et al., U.S. PTO Office Action, U.S. Appl. No. 11/085,625, filed Nov. 21, 2006, 13 pages.

Y. Terao, et al., Notice of Allowance and Fee(s) Due, U.S. Appl. No. 11/008,257, filed Oct. 24, 2006, 11 pgs.
Y. Terao et al., U.S. PTO Office, U.S. Appl. No. 11/085,240, filed Mar. 12, 2007, 15 pages.
Y. Terao et al., U.S. PTO Office, U.S. Appl. No. 11/085,242, filed Mar. 23, 2007, 20 pages.
Y. Terao et al., U.S. PTO Office, U.S. Appl. No. 11/085,248, filed Apr. 10, 2007, 12 pages.
Y. Terao et al., U.S. PTO Office, U.S. Appl. No. 11/085,257, filed Mar. 23, 2007, 23 pages.
Y. Terao et al., U.S. PTO Office, U.S. Appl. No. 11/085,264, filed Mar. 23, 2007, 21 pages.
Y. Terao et al., Notice of Allowance and Fee(s) Due, U.S. Appl. No. 11/008,294, filed Feb. 6, 2007, 7 pages.
Y. Terao et al., Notice of Allowance and Fee(s) Due, U.S. Appl. No. 11/008,381, filed Feb. 22, 2007, 23 pages.
Y. Terao et al., Notice of Allowance and Fee(s) Due, U.S. Appl. No. 11/008,567, filed Feb. 1, 2007, 6 pages.
Y. Terao et al., Notice of Allowance and Fee(s) Due, U.S. Appl. No. 11/085,247, filed Feb. 28, 2007, 14 pages.
Y. Terao et al., U.S. PTO Office Action, U.S. Appl. No. 11/008,131, filed Feb. 8, 2007, 22 pages.
Y. Terao et al., U.S. PTO Office Action, U.S. Appl. No. 11/008,224, filed Feb. 28, 2007, 11 pages.
Y. Terao et al., U.S. PTO Office Action, U.S. Appl. No. 11/008,248, filed Jan. 8, 2007, 25 pgs.
Y. Terao et al., U.S. PTO Office Action, U.S. Appl. No. 11/085,226, filed Jan. 29, 2007, 6 pgs.
Y. Terao et al., Notice of Allowance and Fee(s) Due, U.S. Appl. No. 11/008,142, filed Jan. 5, 2007, 24 pages.
C. Iizuka et al., U.S. PTO Office Action, U.S. Appl. No. 11/085,251, filed Jun. 25, 2007, 28 pgs.
Y. Terao et al., Notice of Allowance and Fee(s) Due, U.S. Appl. No. 11/008,132, filed Jun. 1, 2007, 11 pgs.
Y. Terao et al., Notice of Allowance and Fee(s) Due, U.S. Appl. No. 11/008,294, filed Jun. 14, 2007, 6 pgs.
Y. Terao et al., Notice of Allowance and Fee(s) Due, U.S. Appl. No. 11/008,381, filed Jun. 29, 2007, 6 pgs.
Y. Terao et al., U.S. PTO Office Action, U.S. Appl. No. 11/085,242, filed Jul. 10, 2007, 9 pgs.
Y. Terao et al., U.S. PTO Office Action, U.S. Appl. No. 11/085,250, filed Jun. 20, 2007, 24 pgs.
Y. Terao et al., U.S. PTO Office Action, U.S. Appl. No. 11/085,625, filed Jul. 10, 2007, 11 pgs.
Y. Terao et al., Notice of Allowance and Fee(s) Due, U.S. Appl. No. 11/008,131, Sep. 26, 2007, 12 pages.
Y. Terao et al., U.S. PTO Office Action, U.S. Appl. No. 11/008,199, Aug. 30, 2007, 18 pages.
Y. Terao et al., U.S. PTO Office Action, U.S. Appl. No. 11/008,224, Aug. 28, 2007, 8 pages.
Y. Terao et al., U.S. PTO Office Action, U.S. Appl. No. 11/008,248, Aug. 22, 2007, 8 pages.
Y. Terao et al., Notice of Allowance and Fee(s) Due, U.S. Appl. No. 11/085,264, Sep. 12, 2007, 16 pages.
Y. Terao et al., U.S. PTO Office Action, U.S. Appl. No. 11/822,611, Sep. 25, 2007, 20 pages.
Y. Terao et al., U.S. PTO Office Action, U.S. Appl. No. 11/826,731, Sep. 13, 2007, 21 pages.
Y. Terao et al., Notice of Allowance and Fee(s) Due, U.S. Appl. No. 11/008,299, Jul. 23, 2007, 10 pages.
Y. Terao et al., Notice of Allowance and Fee(s) Due, U.S. Appl. No. 11/085,240, Jul. 24, 2007, 20 pages.
Y. Terao et al., Notice of Allowance and Fee(s) Due, U.S. Appl. No. 11/085,248, Aug. 16, 2007, 8 pages.
Y. Terao et al., U.S. PTO Office Action, U.S. Appl. No. 11/085,257, Jul. 16, 2007, 12 pgs.

* cited by examiner

WAITING TRAY FOR SHEET PROCESSING TRAY

CROSS-REFERENCE TO RELATED APPLICATIONS

This application is based upon and claims the benefit of priority from prior Japanese Patent Application No. 2004-281770, filed Sep. 28, 2004, the entire contents of which are incorporated herein by reference.

BACKGROUND OF THE INVENTION

1. Field of the Invention

The present invention relates to a sheet post-process apparatus, such as a finisher, which is designed for installation at the outlet side of a multi-function peripheral (MFP).

2. Description of the Related Art

A finisher is known, which bundles a plurality of sheets an MFP (Multi-Functional Peripheral) and staples them. In this finisher, the sheets conveyed from the MFP are sequentially conveyed to a processing tray, the conveyed sheets are stapled, and the stapled sheets are conveyed to a storage tray.

This finisher has a second tray for temporarily housing sheets ejected from an image forming apparatus, and, when ejection of the sheet-bundle from a first tray completes, saving them at a predetermined position, and dropping the temporarily housed sheets onto the first tray. However, in this case, there is a need for providing a mechanism for saving the second tray (refer to Jpn. Pat. Appln. KOKAI Publication No. 2001-89009).

Thus, equipment downsizing has been sufficiently achieved.

BRIEF SUMMARY OF THE INVENTION

An object of the present invention is to provide a small sized sheet post-process apparatus. According to an aspect of the present invention, there is provided a sheet post-process apparatus comprising: a plurality of rollers which receive and convey sheets conveyed from an MFP main body; a waiting tray which is provided in the course of a conveying path, and makes standby the sheets conveyed from the rollers in the case where a post-process is required; a conveying mechanism which causes the sheets made standby on the waiting tray to be dropped and moved by self-weight; a processing tray which receives the sheets dropped and moved from the waiting tray and the sheets conveyed from the conveying path without intervening the waiting tray, before carrying out a post-process; a post-process mechanism which carries out a post-process on a bundle of sheets aligned on the processing tray; a sheet-conveying mechanism which conveys the post-processed bundle of sheets from the processing tray; and a storage tray which stacks the bundle of sheets conveyed, wherein an upstream side end in a conveying direction of the sheets on the waiting tray and a downstream side end in a conveying direction of the sheets on the processing tray do not overlap on each other in the conveying direction of the sheets.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of this invention will be described, with reference to the accompanying drawings.

Figure 1:
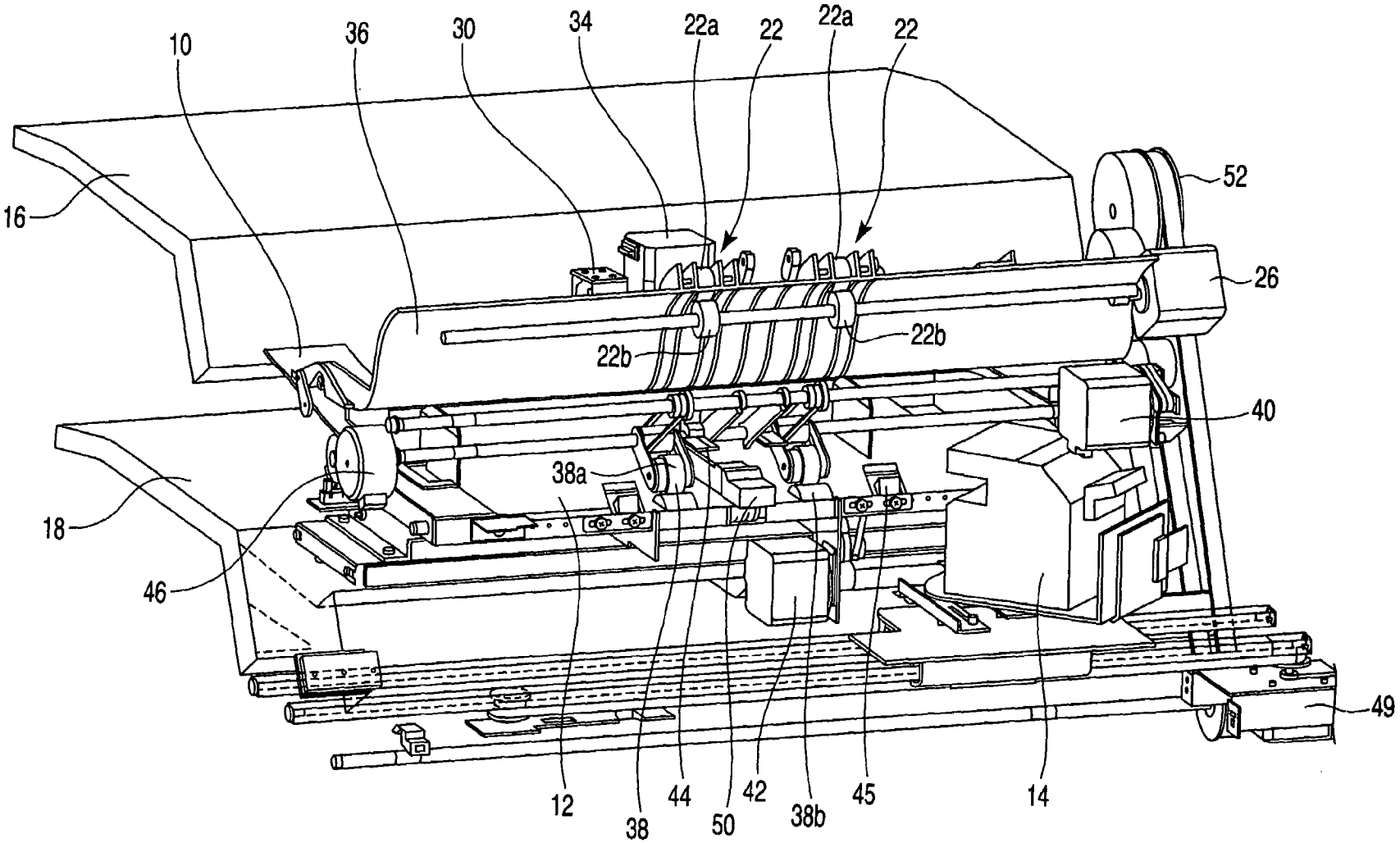
FIG. 1 is a perspective view of a sheet post-process apparatus according to an embodiment of this invention.
Figure 2:
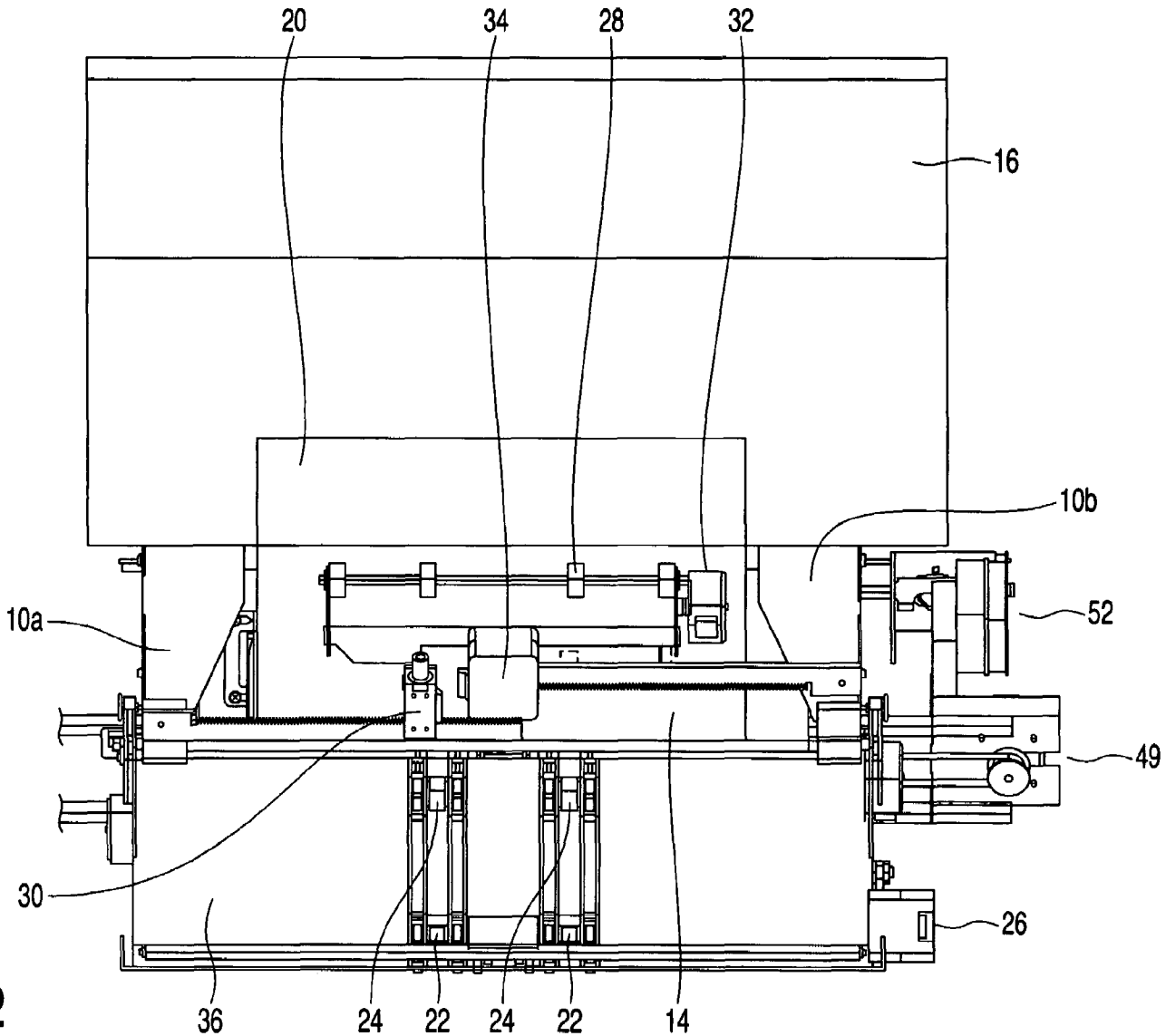
FIG. 2 is a top view of the sheet post-process apparatus in the same embodiment.

FIG. 1 is a perspective view of a sheet post-process apparatus according to this invention. FIG. 2 is a top view of the post-process apparatus of the invention. The post-process apparatus essentially comprises a waiting tray 10, a processing tray 12, a stapler 14, a first storage tray 16, and a second storage tray 18.

A pair of input rollers 22 receive a sheet 20 supplied from an MFP and conveys the sheet 20 to a pair of sheet-feeding rollers 24. The sheet-feeding rollers 24 convey the sheet 20 to the waiting tray 10. A input-roller motor 26 drives the input rollers 22.

The input rollers 22 include an upper input roller 22*a* and a lower input roller 22*b*. Similarly, the sheet-feeding rollers 24 include an upper sheet-feeding roller and a lower sheet-feeding roller.

The waiting tray 10 is composed of a pair of two tray parts 10*a* and 10*b* which can be move to the left and right, and receives a sheet in a state in which the waiting tray parts 10*a* and 10*b* are closed. A waiting tray roller 28 is provided for carrying out alignment of sheets in this state. The waiting tray roller 28 can move vertically, and its control is executed by a waiting tray roller drive source 30. In addition, rotation of the waiting tray roller 28 is carried out by a waiting tray roller motor 32.

Figure 3:
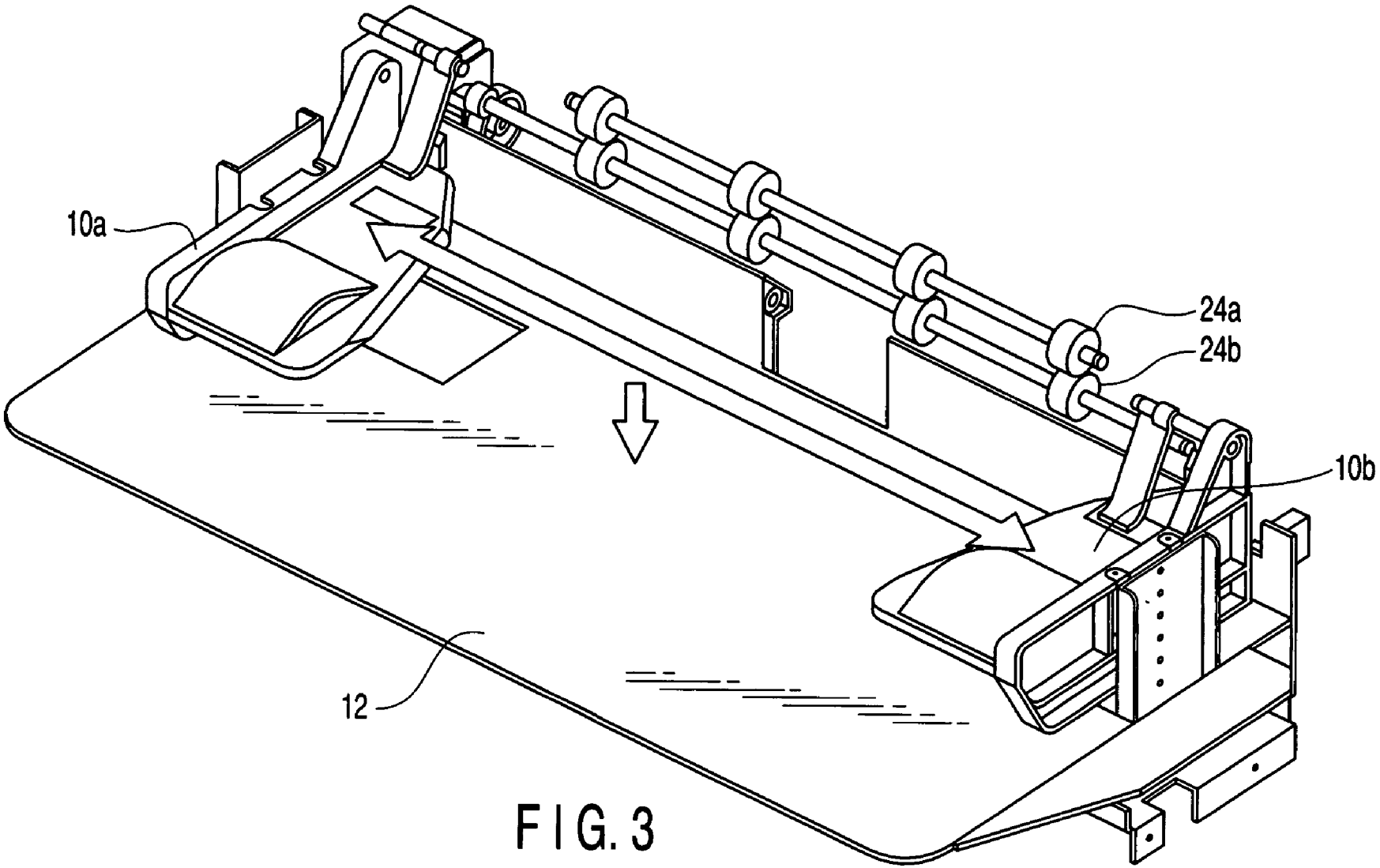
FIG. 3 is a view illustrating an operation of a waiting tray in the same embodiment.

As shown in FIG. 3, a predetermined number of sheets are stacked on the waiting tray 10, the waiting tray parts 10*a* and 10*b* are opened by a waiting-tray motor 34, and the sheets 20 are dropped onto the processing tray 12 by self-weight. This operation is referred to as active drop.

An upstream side end in a conveying direction of the sheets 20 on the waiting tray 10 and a downward side end in a conveying direction of the sheets 20 on the processing tray 12 are allocated so as to be overlapped in the conveying direction of the sheets 20.

An upstream side end in a conveying direction of the sheets 20 on the waiting tray 10 and a downward side end in a conveying direction of the sheets 20 on the processing tray 12 do not overlap in the conveying direction of the sheets 20.

A paper path is provided to guide the sheets conveyed from the MFP to the waiting tray 10 and processing tray 12. This paper path is composed of a paper path ceiling 36.

Figure 4:
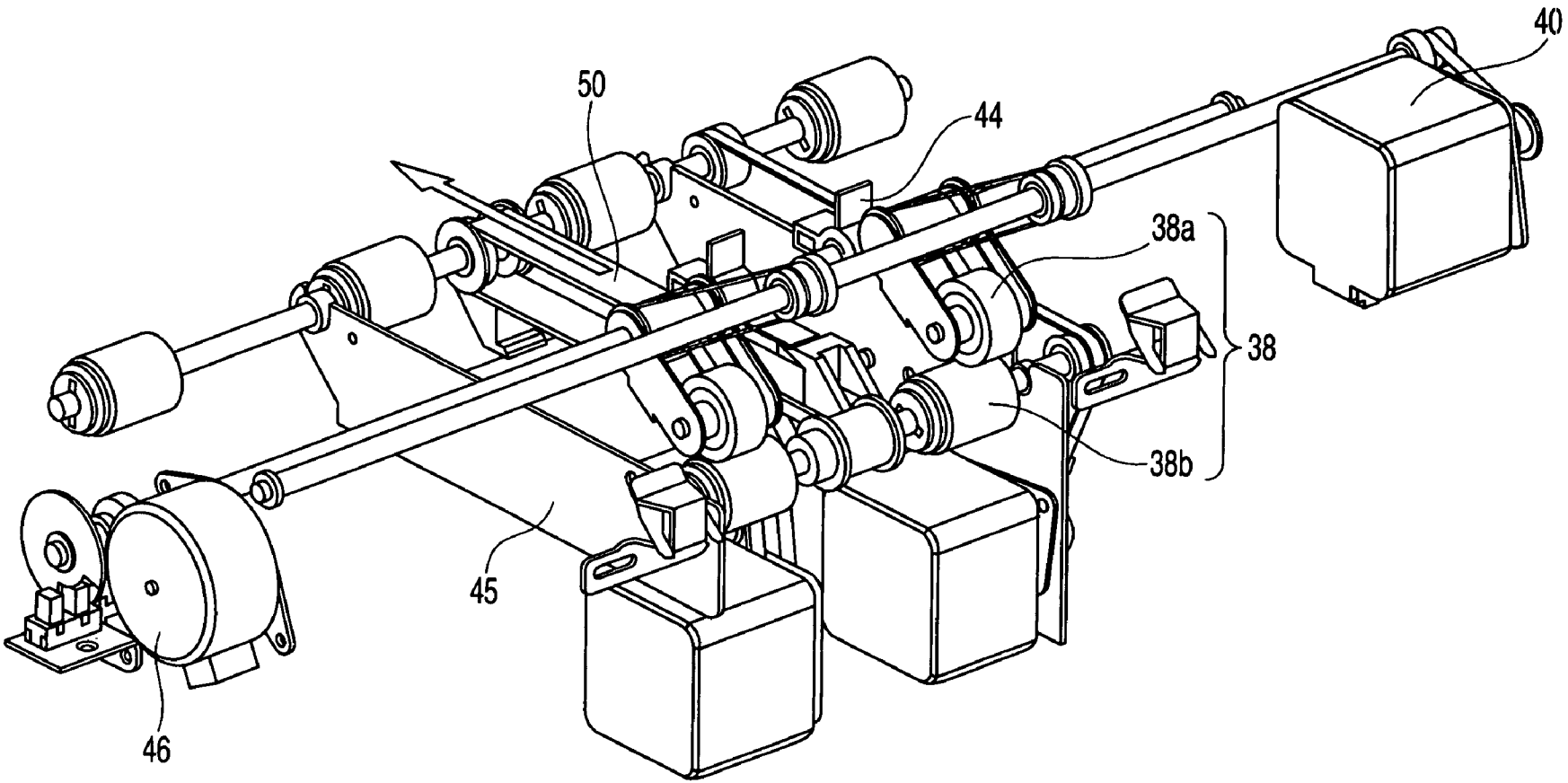
FIG. 4 is a view illustrating longitudinal alignment of the sheet post-process apparatus and a sheet bundle conveying mechanism in the same embodiment.

The sheets conveyed onto the processing tray 12 are subjected to longitudinal and transverse alignments. Longitudinal alignment is made by a longitudinal-alignment mechanism (longitudinal-alignment rollers) 38, as shown in FIG. 4. More precisely, an upper longitudinal-alignment motor 40 drives upper longitudinal-alignment rollers 38*a* of the mechanism 38, and a lower longitudinal-alignment motor 42 drives lower longitudinal-alignment rollers 38*b* of the mechanism 38, thereby aligning the sheets with a stopper 45 as a reference. Paddles 44 are provided to facilitate the longitudinal alignment. A paddle motor 46 drives the paddles 44.

Figure 5:
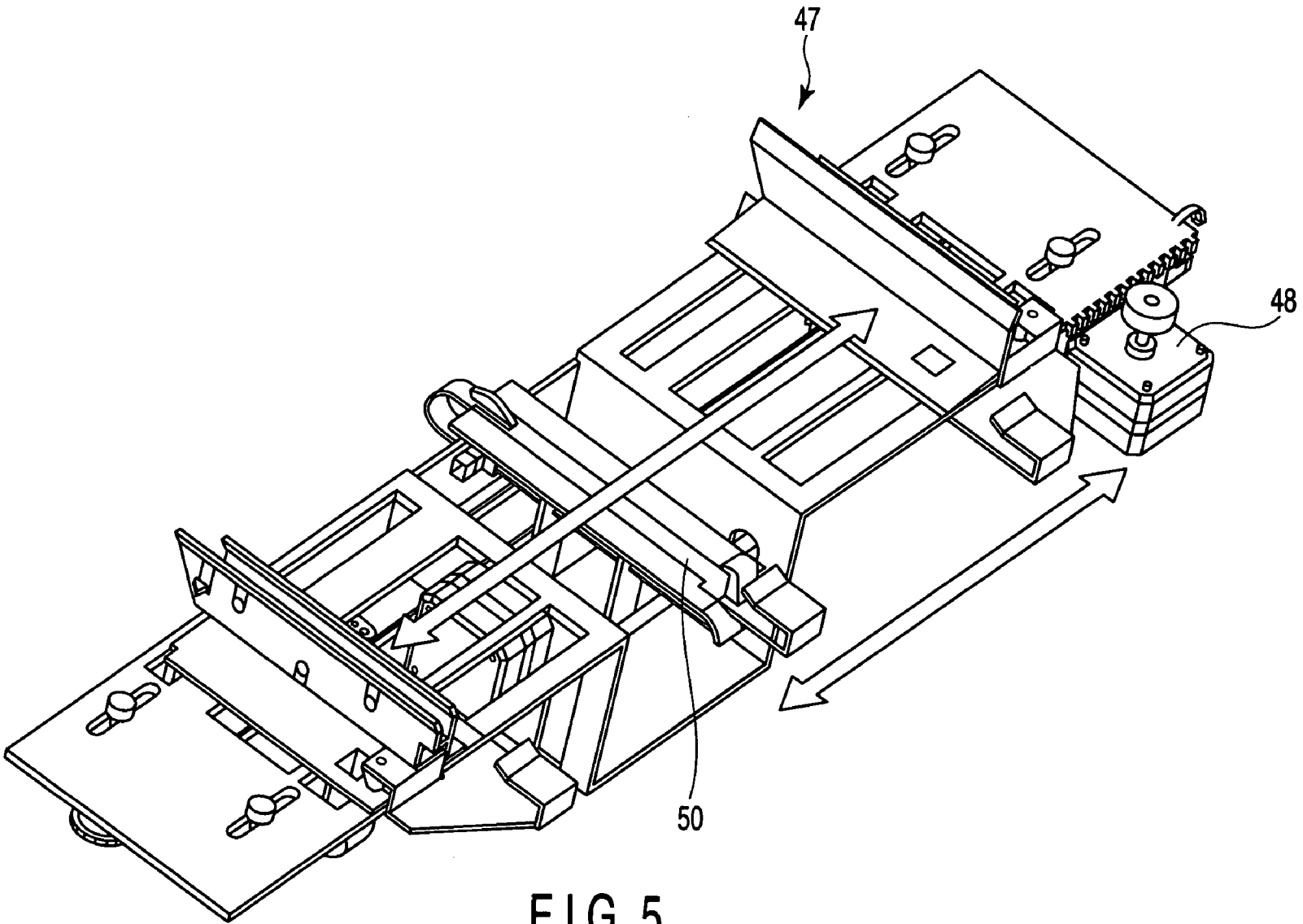
FIG. 5 is a view illustrating a transverse alignment mechanism of the sheet post-processing apparatus in the same embodiment.
Figure 6:
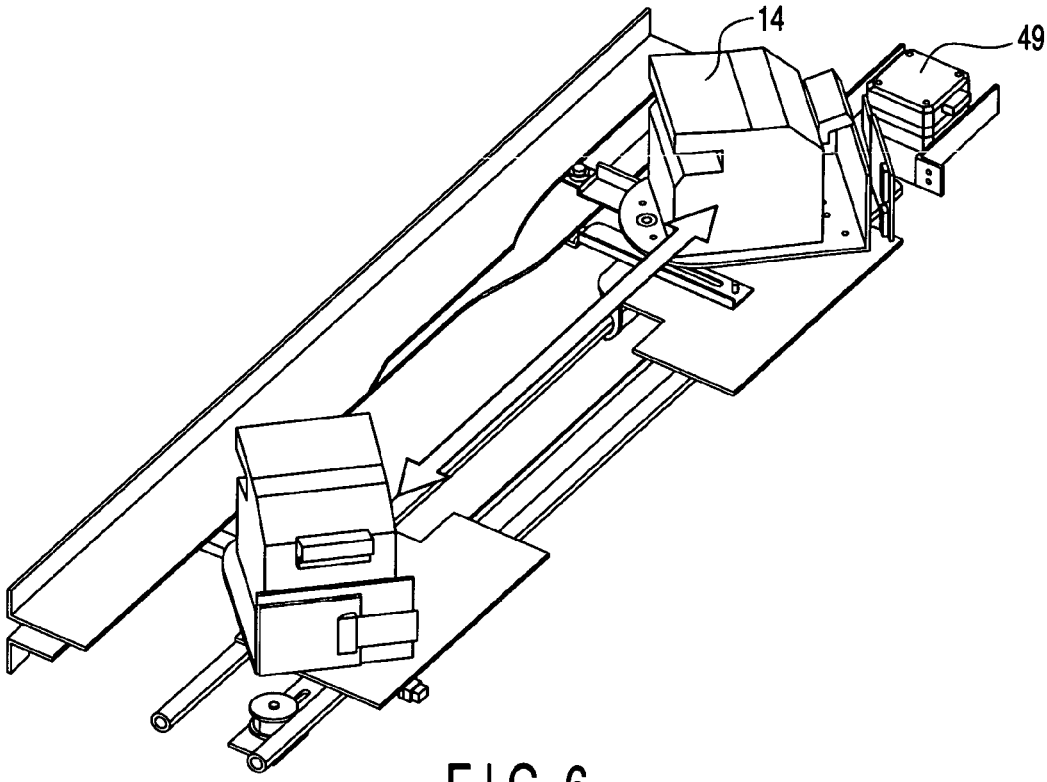
FIG. 6 is a view illustrating an operation of a stapler of the post-process apparatus in the same embodiment.

Transverse alignment is executed by a transverse-alignment mechanism 47 and a transverse-alignment motor 48, as shown in FIG. 5. When a predetermined number of sheets are aligned and stacked on the processing tray 12, staple processing is carried out by the stapler 14. As shown in FIG. 6, the stapler 14 is positioned by a staple-driving unit 49, and staple processing is controlled.

The stapled sheet bundles are conveyed to the storage tray 16 by a conveying mechanism 50. Selection of the storage tray 16 or storage tray 18 is made by vertically moving the storage tray 16 and 18 by means of a storage tray driving unit 52.

An operation of the sheet post-process apparatus according to this invention will be described with reference to FIGS. 7 to 18.

Figure 7:
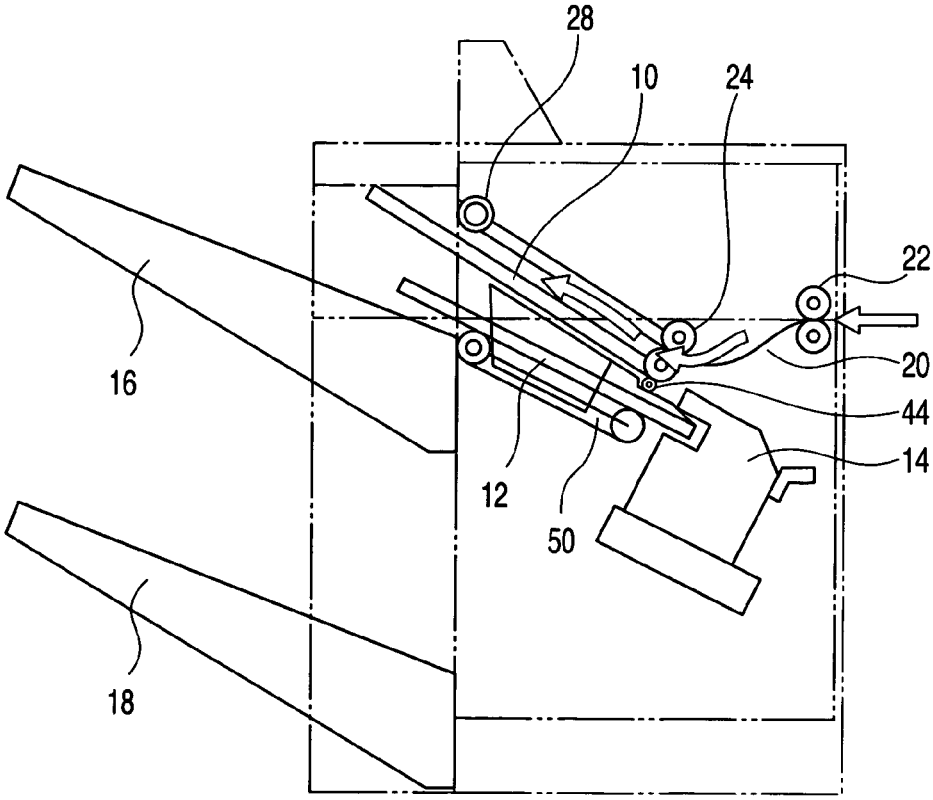
FIG. 7 is a view illustrating a flow of a first sheet of paper between an input roller and a sheet-feeding roller in the sheet post-process apparatus in the same embodiment.

As shown in FIG. 7, the sheet 20 conveyed from the MFP is moved to the sheet-feeding rollers 24 via the input rollers 22 in the direction indicated by the arrow.

Figure 8:
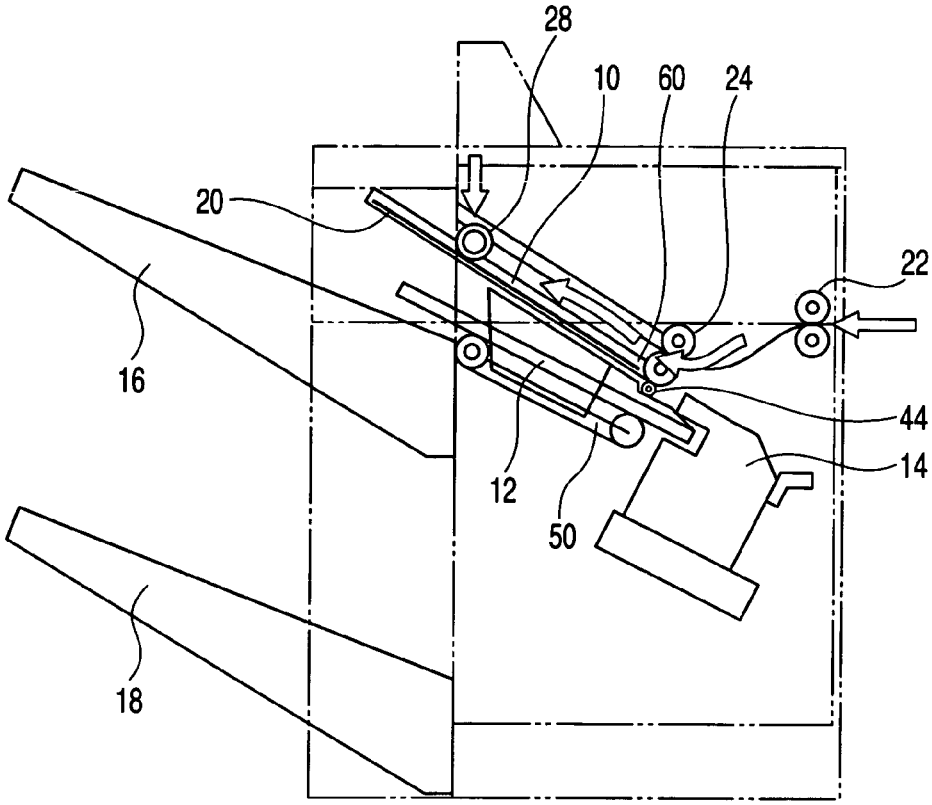
FIG. 8 is a view illustrating a flow of a first sheet of paper between the sheet-feeding roller and the waiting tray in the sheet post-process apparatus in the same embodiment.

Next, as shown in FIG. 8, a first sheet is stacked onto the waiting tray 10 through the sheet-feeding rollers 24. At this time, the waiting-tray rollers 28 move down in the direction indicated by the arrow, and align the trailing edge of the first sheet 20 at the rear (i.e., upstream) end 60 of the waiting tray 10.

Figure 9:
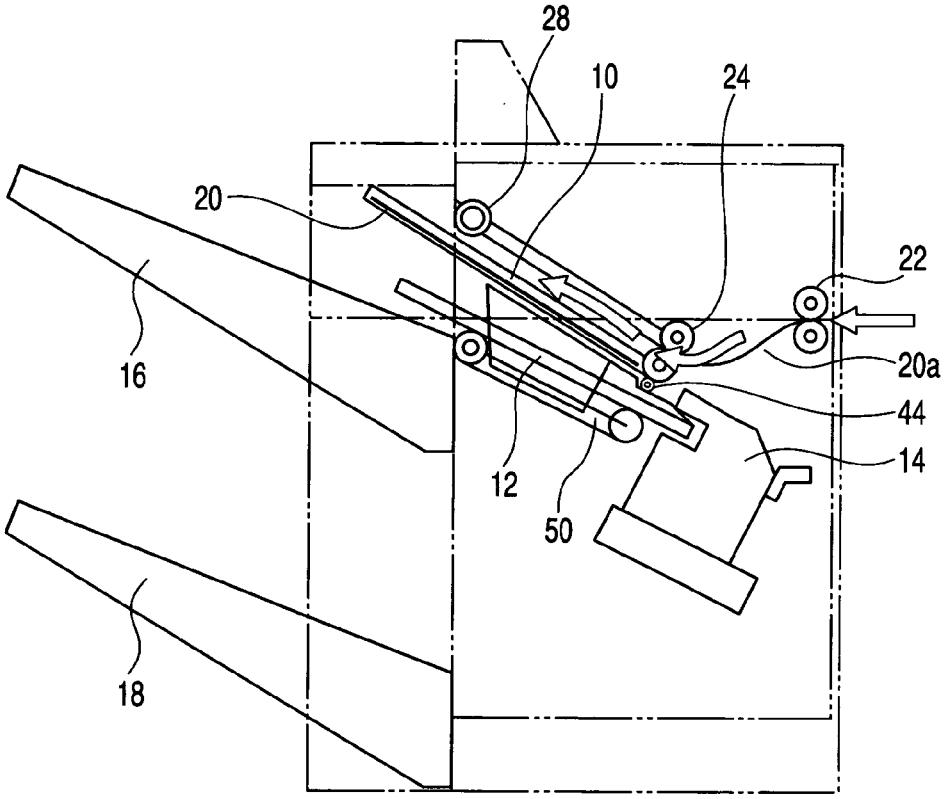
FIG. 9 is a view illustrating a flow of a second sheet of paper between the sheet-feeding roller and the waiting tray in the sheet post-process apparatus in the same embodiment.

Next, as shown in FIG. 9, the waiting-tray rollers 28 move up, and are ready to receive a second sheet 20*a*.

Figure 10:
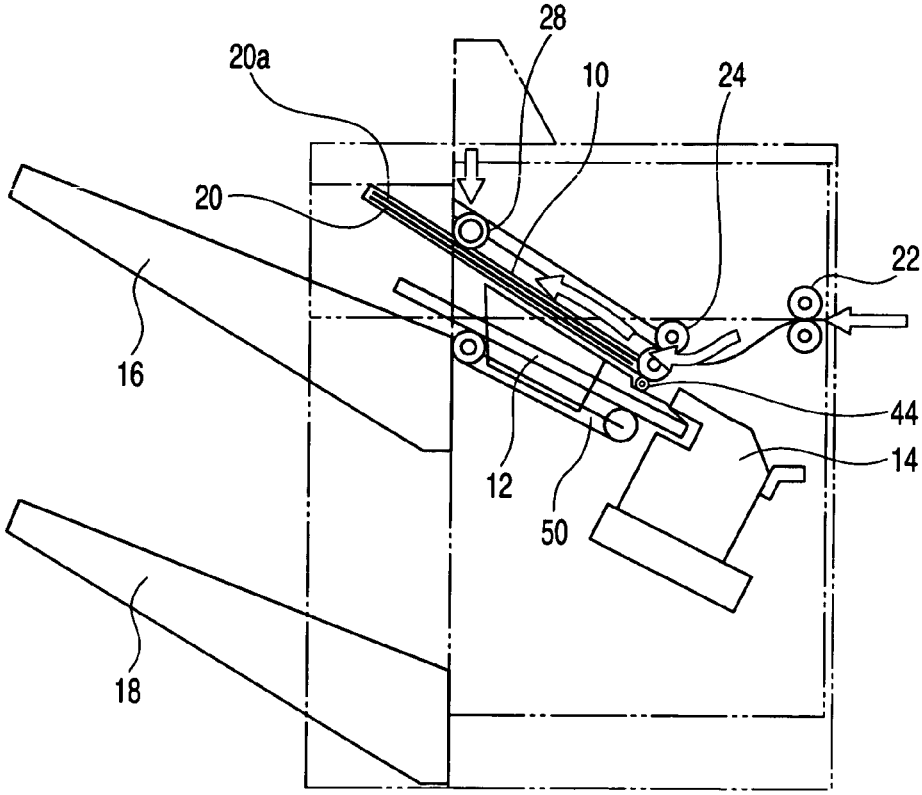
FIG. 10 is a view illustrating an operation of a waiting tray roller in the sheet post-process apparatus in the same embodiment.

When the above receiving is ready, as shown in FIG. 10, the second sheet 20*a* is conveyed to the waiting tray 10. The waiting-tray rollers 28 move down, thereby aligning the trailing edge of the second sheet 20*a* at the rear end 60 of the waiting tray 10. Thus, a bundle 20*b* of two sheets 20 and 20*a* is formed in the waiting tray 10.

Figure 11:
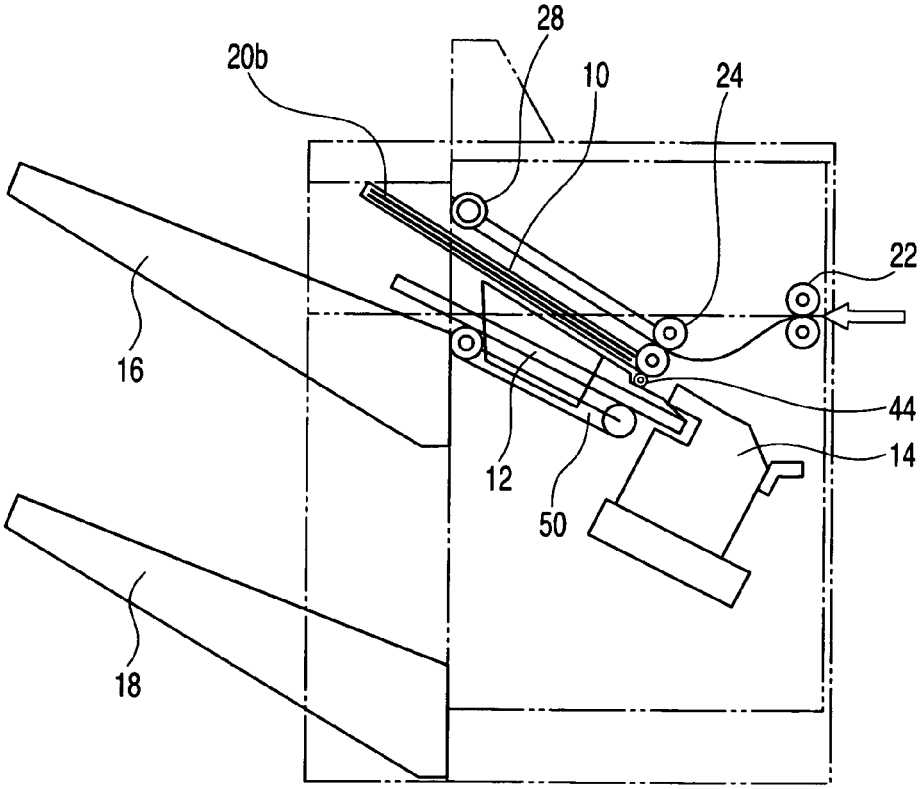
FIG. 11 is a view illustrating an operation of the waiting tray roller in the sheet post-process apparatus in the same embodiment.

Next, as is shown FIG. 11, the waiting-tray rollers 28 move upwards. Further, the waiting-tray parts 10*a* and 10*b* open as shown in FIG. 3. The active drop is executed as shown in FIG. 12, and the bundle 20*b* is moved to be dropped onto the processing tray 12.

Figure 12:
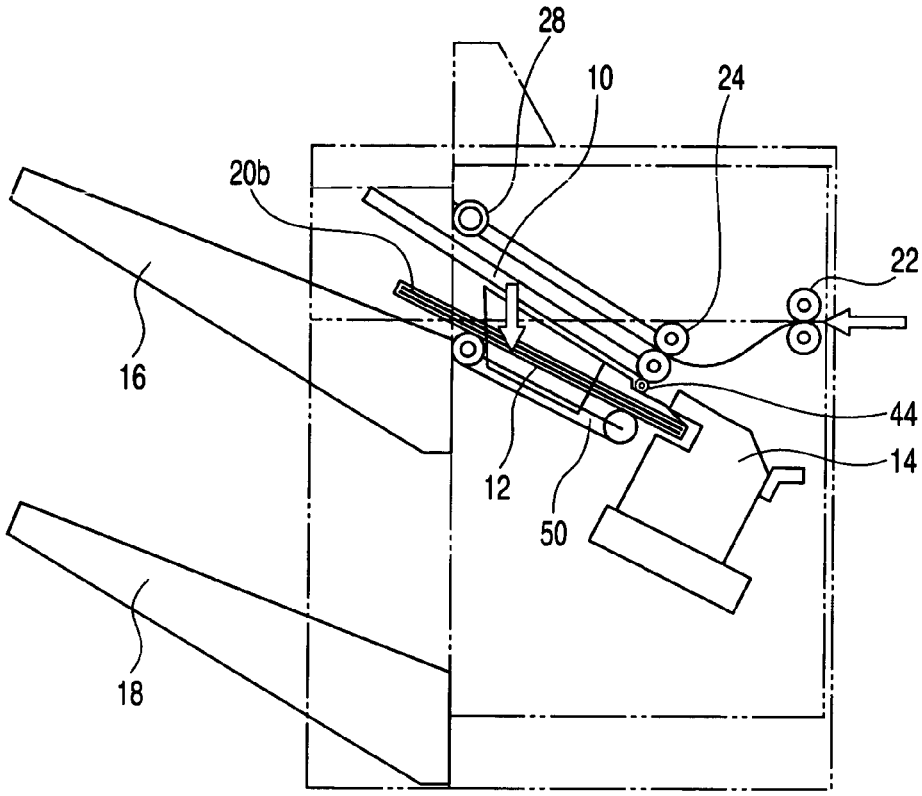
FIG. 12 is a view illustrating an operation of active drop in the sheet post-process apparatus in the same embodiment.

At this time, as shown in FIG. 12, the waiting tray 10 is allocated so that an upstream side end in the conveying direction of the sheet bundle 20*b* and a downstream side end in the conveying direction of the sheet bundle 20*b* on the processing tray 12 overlap on each other in the conveying direction of the sheet bundle 20*b*. Thus, when the sheet bundle 20*b* is moved to be dropped from the waiting tray 10 to the processing tray 12, the sheet bundle 20*b* can be well placed on the processing tray 12.

As has been described above, the sheet bundle 20*b* is configured so as to be moved to be dropped. Thus, in the case where a roller or the like is used as conveying means, a conventional member which has been believed as a technique can be eliminated or simplified, thus making it possible to help achieve an inexpensive structure. In addition, as has been described above, there is provided a structure of making the sheet bundle 20*b* standby on the waiting tray 10, opening the waiting tray parts 10*a* and 10*b*, and dropping the sheet bundle 20*b* onto the processing tray 12. Thus, the downsizing of the sheet post-process apparatus can be achieved.

Figure 13:
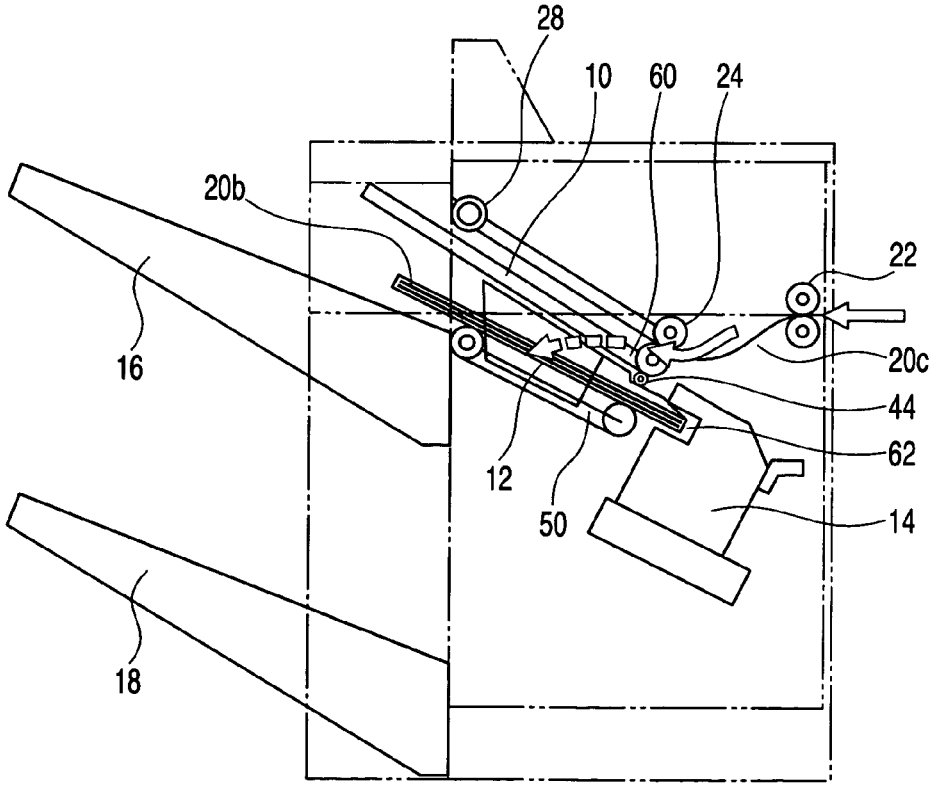
FIG. 13 is a view illustrating a flow of a third sheet of paper in the sheet post-process apparatus in the same embodiment.

Then, the third and subsequent sheets 20*c* are conveyed from the sheet-feeding roller 24 directly to the processing tray 12 without intervening the waiting tray 10, as shown in FIG. 13. The conveyed sheets are stacked onto the two sheet bundles 20*b*, and a predetermined number of sheet bundles 21 are formed. At this time, the longitudinal and vertical alignment mechanisms 38 and 47 function, whereby longitudinal and transverse sheet alignments are executed.

Figure 14:
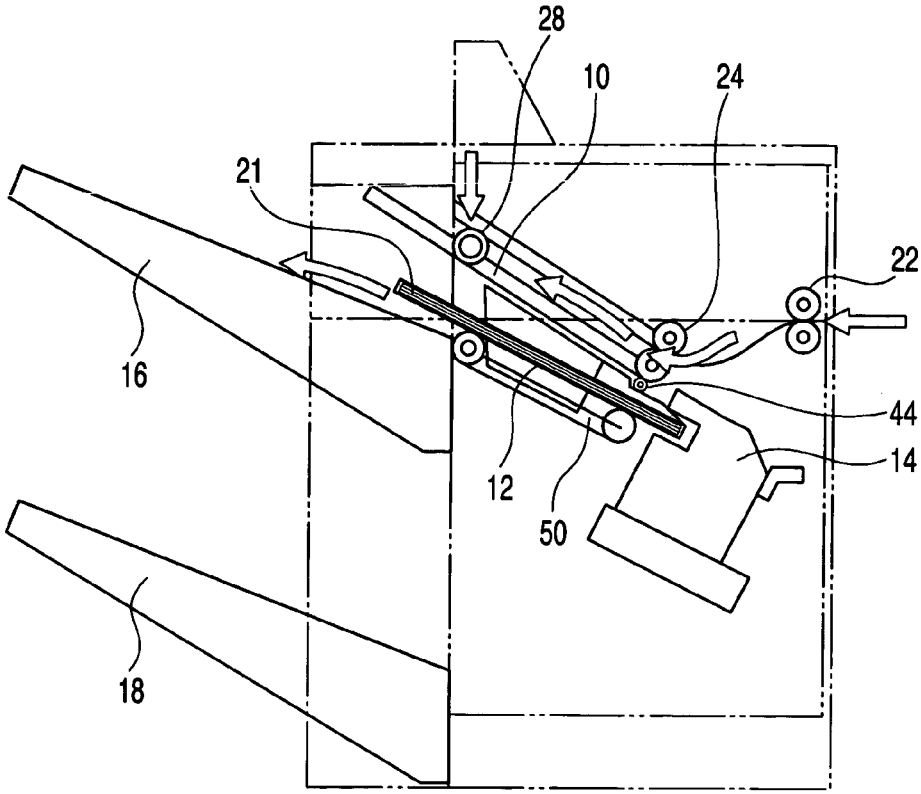
FIG. 14 is a view illustrating an operation of the stapler in the sheet post-process apparatus in the same embodiment.
Figure 15:
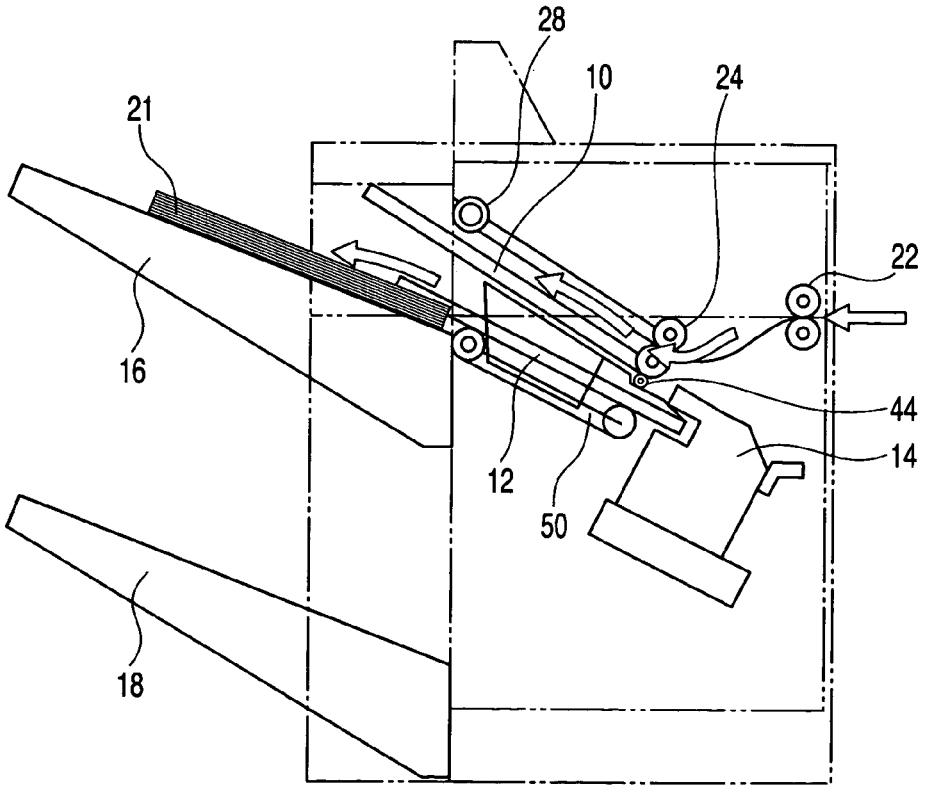
FIG. 15 is a view of illustrating a flow of a sheet-bundle between a processing tray and a storage tray in the sheet post-process apparatus in the same embodiment.

Next, as shown in FIG. 14, the sheet bundle 21 is stapled by the stapler 14. Then, as shown in FIG. 15, the sheet bundle 20 is conveyed to the storage tray 16 by the conveying mechanism 50, and a post-process is terminated.

Figure 16:
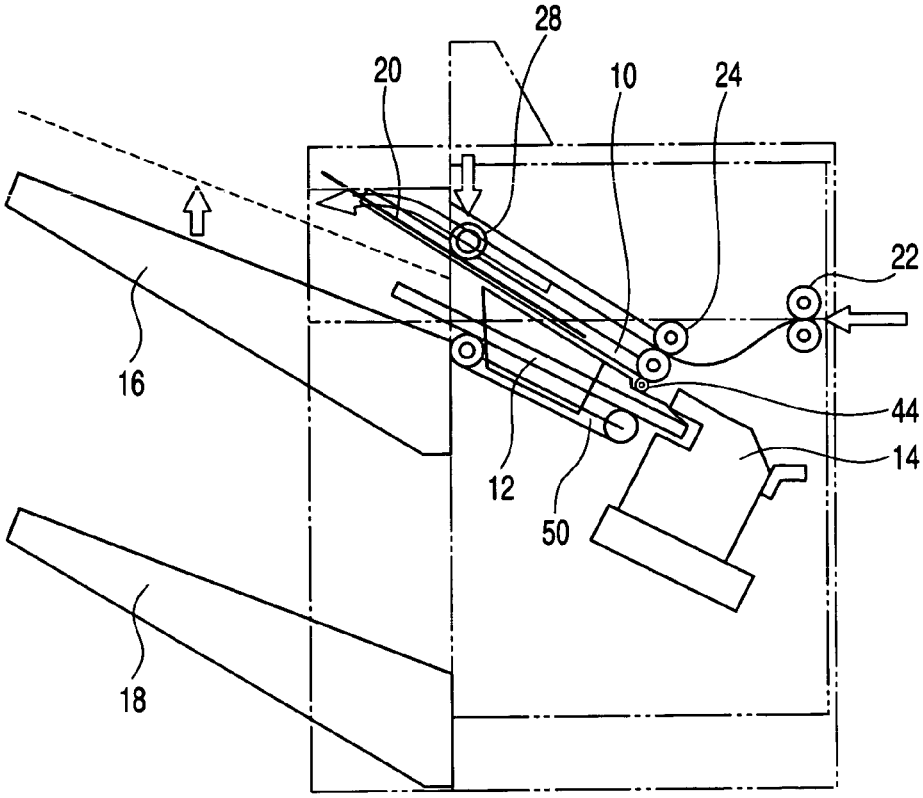
FIG. 16 is a view illustrating a flow when sheets are directly ejected from the waiting tray to the storage tray in the sheet post-process apparatus in the same embodiment.
Figure 17:
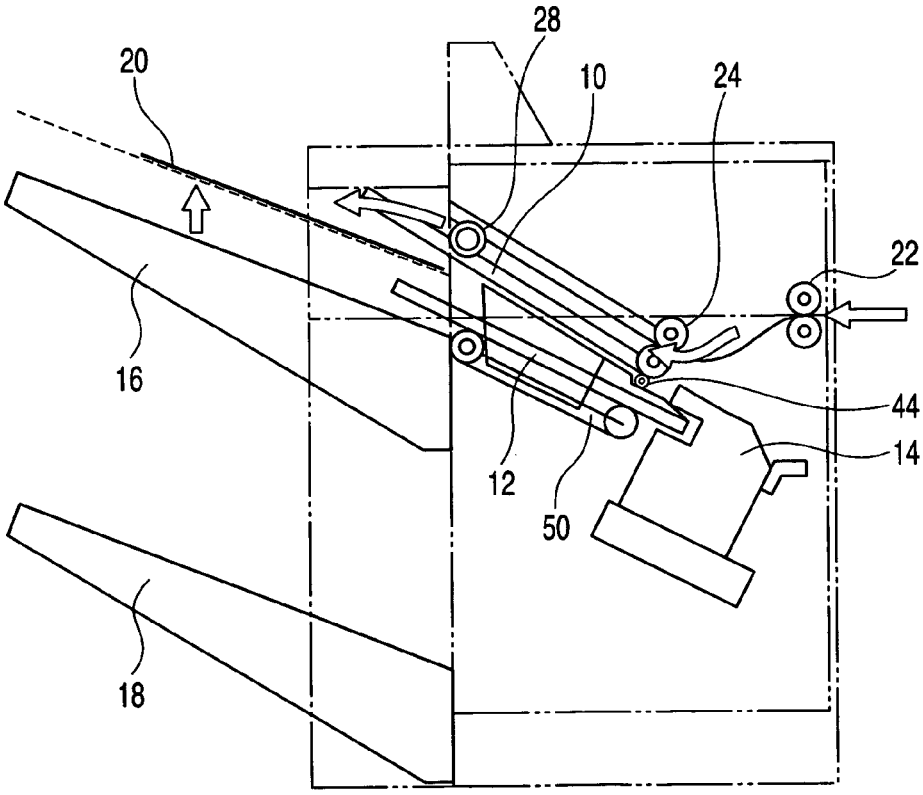
FIG. 17 is a view illustrating an operation for changing a position of the storage tray in the sheet post-process apparatus in the same embodiment.

In the case where no post-process is required, the sheets are ejected from the waiting tray 10 directly to the storage tray 16 without intervening the processing tray 12, as shown in FIGS. 16 and 17. As is shown in FIG. 16, the sheets supplied from the MFP are sequentially conveyed to the first storage tray 16 via the input rollers 22, sheet-feeding rollers 24 and waiting tray 10. The waiting-tray rollers 28 move down, serving to convey the sheets 20. As depicted in FIG. 17, the first storage tray 16 is slightly lifted by the storage tray driving unit 52, and receives the sheets conveyed from the waiting tray 10.

One of the above embodiments describes a construction in which the upstream side end in the conveying direction of the sheets on the waiting tray 10 and the downstream side end in the conveying direction of the sheets 20 on the processing tray 12 are disposed not to overlap in the conveying direction of the sheets 20. However, unlike such one embodiment, in the case where the waiting tray 10 and the processing tray 12 are configured so as to be inclined downwardly on the downstream side in the conveying direction of the sheets 20, similar advantageous effect can be attained even if the downstream side end in the conveying direction of the sheets on the waiting tray 10 and the upstream side end in the conveying direction of the sheets 20 on the processing tray 12 are allocated not to overlap on each other in the conveying direction of the sheets 20.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheet post-process apparatus, comprising:

a plurality of rollers which receive and convey sheets conveyed from a multi-function peripheral;

a waiting tray which is provided in a conveying path, and holds some of the sheets conveyed from the rollers when a bundle of sheets needs to be post-processed;

a processing tray which receives the sheets from the waiting tray and other sheets forming the bundle of sheets, before the bundle of sheets is post-processed, wherein the waiting tray and the processing tray are arranged vertically with a vertical distance from an upstream end of the waiting tray to a downstream end of the processing tray being shorter than a vertical distance from a downstream end of the waiting tray to an upstream end of the processing tray;

a post-process mechanism which carries out a post-process on the bundle of sheets on the processing tray; and a storage tray which stacks the bundle of sheets conveyed, wherein the bundle of sheets is provided across and in contact with both the processing tray and an end portion of the storage tray before being post-processed and stacked on the storage tray, and wherein the waiting tray includes two tray parts that move in a horizontal direction.

2. The sheet post-process apparatus according to claim 1, further comprising a conveying mechanism which causes the sheets on the waiting tray to be conveyed to the processing tray.

3. The sheet post-process apparatus according to claim 1, further comprising a sheet-conveying mechanism which conveys the post-processed bundle of sheets from the processing tray to the storage tray.

4. The sheet post-process apparatus according to claim 1, wherein the processing tray holds the other sheets conveyed via the conveying path without being conveyed to the waiting tray before the bundle of sheets is post-processed.

5. The sheet post-process apparatus according to claim 1, wherein the waiting tray includes an alignment mechanism.

6. The sheet post-process apparatus according to claim 1, wherein the processing tray includes an alignment mechanism.

7. A sheet post-process apparatus, comprising:

a plurality of rollers which receive and convey sheets conveyed from a multi-function peripheral;

a waiting tray which is provided in a conveying path, and holds some of the sheets conveyed from the rollers when a bundle of sheets needs to be post-processed;

a processing tray which receives the sheets from the waiting tray and other sheets forming the bundle of sheets, before the bundle of sheets is post-processed, wherein the waiting tray and the processing tray are arranged vertically with a vertical distance from an upstream end of the waiting tray to a downstream end of the processing tray being shorter than a vertical distance from a downstream end of the waiting tray to an upstream end of the processing tray;

means for carrying out a post-process on the bundle of sheets on the processing tray; and a storage tray which stacks the conveyed bundle of sheets, wherein the bundle of sheets is provided across and in contact with both the processing tray and an end portion of the storage tray before being post-processed and stacked on the storage tray, and wherein the waiting tray includes two tray parts that move in a horizontal direction.

8. The sheet post-process apparatus according to claim 7, further comprising a conveying mechanism which causes the sheets on the waiting tray to be conveyed to the processing tray.

9. The sheet post-process apparatus according to claim 7, further comprising a sheet-conveying mechanism which conveys the post-processed bundle of sheets from the processing tray to the storage tray.

10. The sheet post-process apparatus according to claim 7, wherein the processing tray holds the other sheets conveyed via the conveying path without being conveyed to the waiting tray before the bundle of sheets is post-processed.

11. The sheet post-process apparatus according to claim 7, wherein the waiting tray includes an alignment mechanism.

12. The sheet post-process apparatus according to claim 7, wherein the processing tray includes an alignment mechanism.

* * * * *